United States Patent [19]

Markus et al.

[11] 3,955,739

[45] May 11, 1976

[54] HYDRAULICALLY OPERATED RIVETING MACHINE

[75] Inventors: Richard L. Markus, Bridgeport, Conn.; William P. Hidden, Wenham; Daniel F. Hefler, Concord, both of Mass.

[73] Assignee: The Milford Rivet & Machine Company, Milford, Conn.

[22] Filed: Dec. 30, 1974

[21] Appl. No.: 537,603

[52] U.S. Cl. ..... 227/1; 227/51; 60/539

[51] Int. Cl.[2] ..... B21J 15/20

[58] Field of Search ..... 227/1, 2, 51, 53, 55; 60/533, 537, 538, 539, 594; 74/25, 55; 192/12 R, 131 R

[56] References Cited

UNITED STATES PATENTS

| | | | |
|---|---|---|---|
| 2,752,061 | 6/1956 | Michlein | 227/62 |
| 3,106,823 | 10/1963 | Thompson | 60/539 |
| 3,286,465 | 11/1966 | Cerles et al. | 60/537 |
| 3,370,428 | 2/1968 | Van Deberg | 60/539 |
| 3,416,715 | 12/1968 | Fenimore | 227/3 X |
| 3,552,628 | 1/1971 | Hotchkiss | 227/51 |

*Primary Examiner*—Granville Y. Custer, Jr.
*Attorney, Agent, or Firm*—Ernest M. Junkins

[57] ABSTRACT

A hydraulically actuated power cylinder reciprocates a driver to exert a compressive force to upset a rivet with the power cylinder's movement being made to correspond to the movement of a pump cylinder by a fluid connection therebetween. The pump cylinder's movements are mechanically actuated according to a programmed cam and actuation is made to occur only during the riveting cycle by a control circuit operating a clutch and brake with the circuit inhibiting operation upon the sensing of a malfunction.

11 Claims, 6 Drawing Figures

32
28
20
31
29
30
27
23
21
22
25
24
26
33
35
34
17
15
16
10
40
41
11
19
18
38
36
14
13
12
39
69
37
71
42
43
29
20
30
21
40
44
45
41
46
47
38
39
36

HYDRAULICALLY OPERATED RIVETING MACHINE

The present invention relates to a riveting machine in which a rivet or other fastener is mechanically axially compressed between a stationary anvil and a movable driver to deform, spread or otherwise upset the fastener. The driver is mounted for reciprocating movement towards and away from the anvil to effect a riveting cycle of fast advancing from a rest position, slow advancing to effect the upsetting and quick retraction to its rest position.

While such machines have heretofore been suggested they have generally used mechanical devices such as single revolution clutches and a fly wheel for providing the driver movement, though in U.S. Pat. No. 3,552,628 assigned to the assignee of the present invention, there is disclosed a hydraulically powdered riveting machine. Though such a fluid actuated machine has been found operable, it relied on continuously maintaining the fluid under pressure, was somewhat difficult to alter to a different riveting cycle and tended to be difficult to control during a riveting cycle as when an emergency stop was demanded.

It is accordingly an object of the present invention to provide a riveting machine in which the driver is hydraulically actuated but in which pressurized fluid is only necessary during the riveting cycle.

Another object of the present invention is to provide a riveting machine in which the movement of a driver is controlled by a closed hydraulic circuit that includes a power cylinder connected to move the driver and a pump cylinder for providing pressurized hydraulic fluid to the power cylinder with the movement of the power cylinder corresponding to the movement of the pump cylinder.

A further object of the present invention is to achieve the above object with a riveting machine in which the movement of the pump cylinder is mechanically programmed to thereby regulate the movement of the power cylinder during an operating cycle and in which the program may be relatively easily changed for different operating situations.

Still another object of the present invention is to provide a riveting machine that has a hydraulically operated driver in which essentially instantaneous control over the driver movement is achieved.

Still another object of the present invention is to provide a hydraulic circuit that includes a power cylinder and a pump cylinder in which pressurizing of fluid is caused to occur only when it is desired to produce motion and in which the power for the motion is derived from an electric motor through appropriate clutch and brake devices.

In carrying out the present invention, the riveting machine herein disclosed includes a stationary anvil that cooperates with a reciprocating driver to effect the upsetting of a fastener positioned therebetween. The driver is actuated through a toggle mechanism by the movement of a piston of a power cylinder with one complete reciprocation of the piston causing the driver to also have one reciprocating movement which constitutes a riveting cycle. Such a cycle includes a relatively fast advancing movement from a rest position, a slow, powerful advancing movement for upsetting the fastener and a quick retracting return stroke to the initial position.

The movement of the power piston is controlled by the pressure of hydraulic fluid that engages opposite sides thereof and the pressure is obtained from hydraulic connections to opposite ends of another piston forming part of a pump cylinder with the connections basically consisting only of hydraulic hoses. The pump piston motion and hence the corresponding driver motion is derived from a cam that is rotated and has the shape desired for the required motion. Thus, by shaping the cam, the exact motion that is required for the riveting cycle may be obtained and by changing the cam, a different motion may be obtained.

The rotation of the cam is by an electric motor which is preferably maintained continuously operating and is interconnected to the cam by way of a clutch. Accordingly, the piston is caused to be moved only when the clutch effects coupling of the motor and cam and in the absence of a coupling, a brake is connected to stop and prevent cam movement. As the brake and clutch may be quickly actuated, essentially instantaneous control over the movement of the driver by way of cessation of movement of the pump piston is accordingly obtained.

The riveting machine further includes an electrical circuit for controlling the energization of the clutch and brake and also for effecting upon momentary actuation, one complete riveting cycle. Moreover, the circuit includes a pair of sensing circuits which determine independently if malfunctioning has occurred in the prior cycle and prevents the next cycle by one sensing circuit being responsive to the mechanical position of the cam at the end of the cycle and by the other sensing circuit being responsive to the length of time that the clutch was energized for the prior riveting cycle.

Other features and advantages will hereinafter appear -

In the drawing

Figures 1, 2:
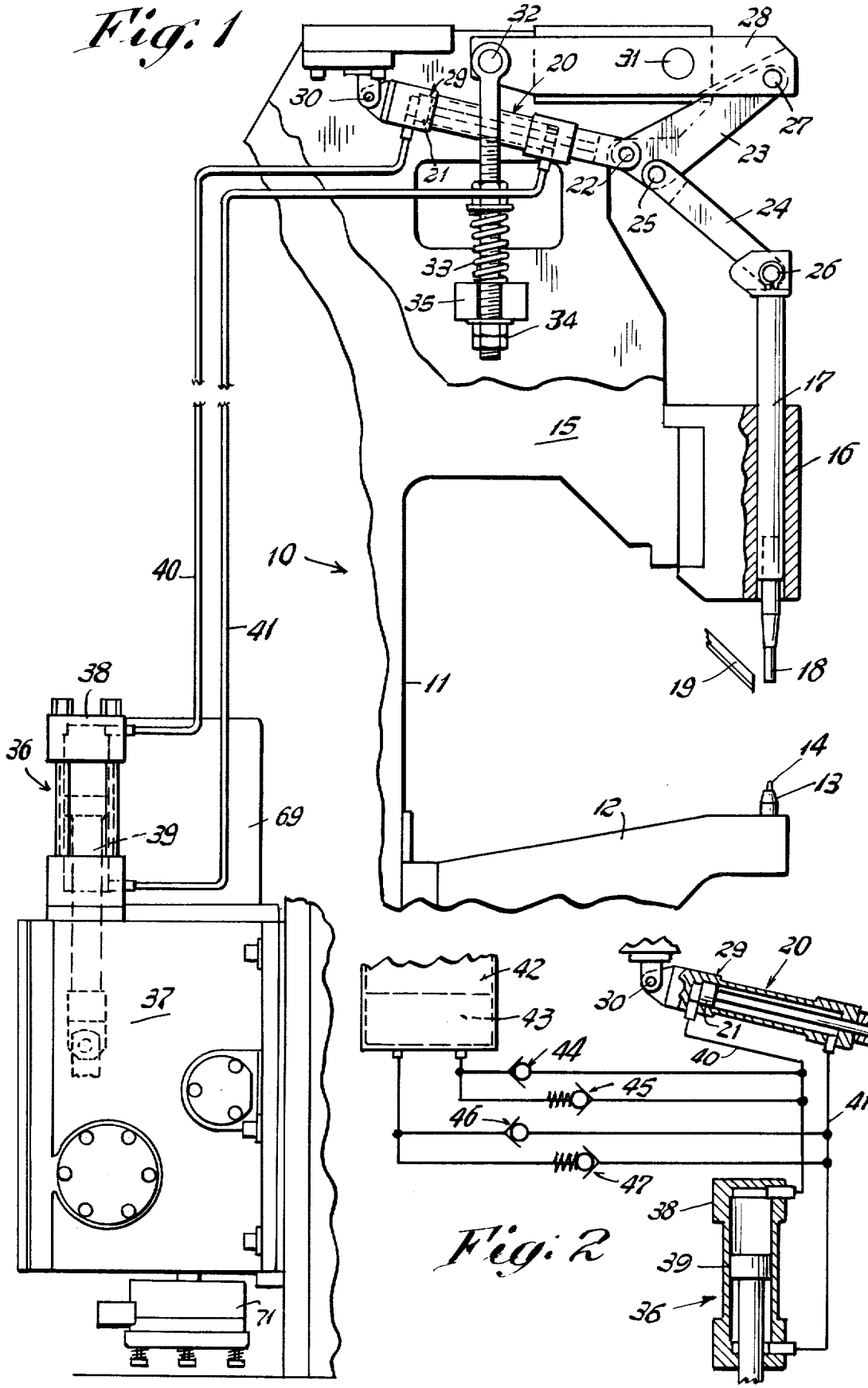
FIG. 1 is an elevation, partly in section and broken away, of the riveting machine of the present invention.
FIG. 2 is a parts and schematic diagram of the hydraulic components of the present invention.

Referring to the drawing, the riveting machine of the present invention is generally indicated by the reference numeral 10 and includes a frame 11 having an outwardly extending projection 12 on which a stationary anvil 13 is supported for holding a tool 14. The frame further includes a bifurcated overhanging portion 15 which is formed to provide a bore 16 in which a driver 17 having an upsetting tool 18 is positioned. A portion of a rivet supplying chute 19 is also shown while not shown, is the usual mechanism for grasping each rivet and maintaining it in the position to be upset. A rivet is thus positioned between the stationary tool 14 and the upsetting tool 18 and as the upsetting tool is reciprocated it axially compresses the rivet or other fastener to upset or spread the end portion of the rivet.

The reciprocating movement of the tool carrying driver 17 is produced by a double ended power cylinder 20 that has a movable piston 21 which is connected by a pivot pin 22 to an end of an arm 23 of a toggle that includes another arm 24. The arms are interconnected by a pivot pin 25 while the other end of the arm 24 is pivotally connected to the driver 16 as at 26 and the other end of the arm 23 is pivotally connected as at 27 to an elongate U-shaped bracket 28. The power cylinder also includes a housing 29 which is pivoted as at 30 to the overhanging support 15.

With this construction, it will be understood that as the piston 21 is moved outwardly from within the housing 29, it causes the toggle consisting of arms 23 and 24 to become aligned which produces the advancing motion of the driver 17 in the riveting cycle while a movement of the piston leftwardly or into the housing causes the arms 24 and 23 to assume angularity to effect the retraction movement of the driver 17. It will be noted that the interconnection between the piston and the driver is positive so that all movements of the driver occur only with a corresponding movement of a piston 21.

While the driver movement is dictated by the piston movement, the present machine mechanically reduces driver movement if the driver encounters an obstruction which would require an excessive force to be exerted to continue driver movement. Thus, though the power piston may continue to move, some of its movement is absorbed without being transmitted to the driver. This is achieved by pivotally mounting, as at 31, the elongate U-shaped bracket 28 and fastening a rod 32 to the end of the bracket remote from the pivot 27. A spring 33 encircles a portion of the rod between a nut 34 threaded on the rod and a fixed support 35. Thus, if the driver in its movement encounters an obstruction which would require an excessive force or further movement, the bracket 28 will pivot against the tension produced by the spring 33 to thereby absorb the further movement of the piston and prevent a corresponding movement of the driver 17. The spring force is adjustable thereby enabling the value of the excessive force to be altered to that desired.

The movement of the power piston 21 is in accordance with hydraulic pressure exerted thereon and the pressure is obtained from a pump cylinder 36 constituting part of a power module 37. The cylinder 36 includes a stationary double ended housing 38 and a movable piston 39. A hydraulic hose 40 interconnects the ends of the cylinder opposite the free ends of each piston while a hydraulic hose 41 connects the piston rod ends of the cylinders together. Shown in FIG. 2 is a schematic diagram of the hydraulic system with corresponding parts being indicated by having the same heretofore mentioned reference characters. A reservoir 42 has hydraulic fluid 43 therein and is connected to the hose 40 by way of a one-way valve 44 which only enables fluid to flow from the reservoir 42 to the hose 40 and by a pressure relief valve 45. The valve 45 is set to the maximum pressure at which it is desired for the hose 40 to transmit and any pressure thereabove will be passed from the hose into the reservoir with one example being 500 p.s.i. Similarly the hose 41 has a one-way valve 46 for permitting fluid flow into the hose 41 from the reservoir and also a pressure relief valve 47 for preventing excess pressure by enabling flow into the reservoir.

The system uses hydraulic fluid which is essentially incompressible and as the system is essentially a closed system, any movement by one piston results in an equal volumetric movement in the opposite direction by the other piston. While it is contemplated that both the pump cylinder and the power cylinder could be of identical construction so that the exact movement of the pump cylinder will produce an identical movement of the power cylinder, it is preferred to have the pump cylinder of a larger diameter than the power cylinder to thereby produce different relative linear movements of the two pistons. Thus, for example, the pump cylinder could perhaps be double the diameter of the power cylinder and the distance moved by the power piston will be a multiple of the distance moved by the pump piston. In one embodiment, the diameters have a 2 to 1 ratio as, for example, .75 inch to 1 ½ inches diameter which could cause an almost 4 to 1 multiplication of the pump piston stroke so that a pump piston stroke of 1 ½ inches could produce a theoretical power piston stroke of 6 inches.

It should be noted that the hose 40 which interconnects the ends of the cylinders that are opposite the free ends of the pistons has the hydraulic pressure therein for the driver advancing and riveting upsetting movement which enables the pressure of hydraulic fluid to be exerted over the full surface area of the piston thereby extending the force produced. The hose 41 is utilized to effect the return stroke of the driver which requires relatively little force on the smaller rod end of the power piston.

Figure 3:
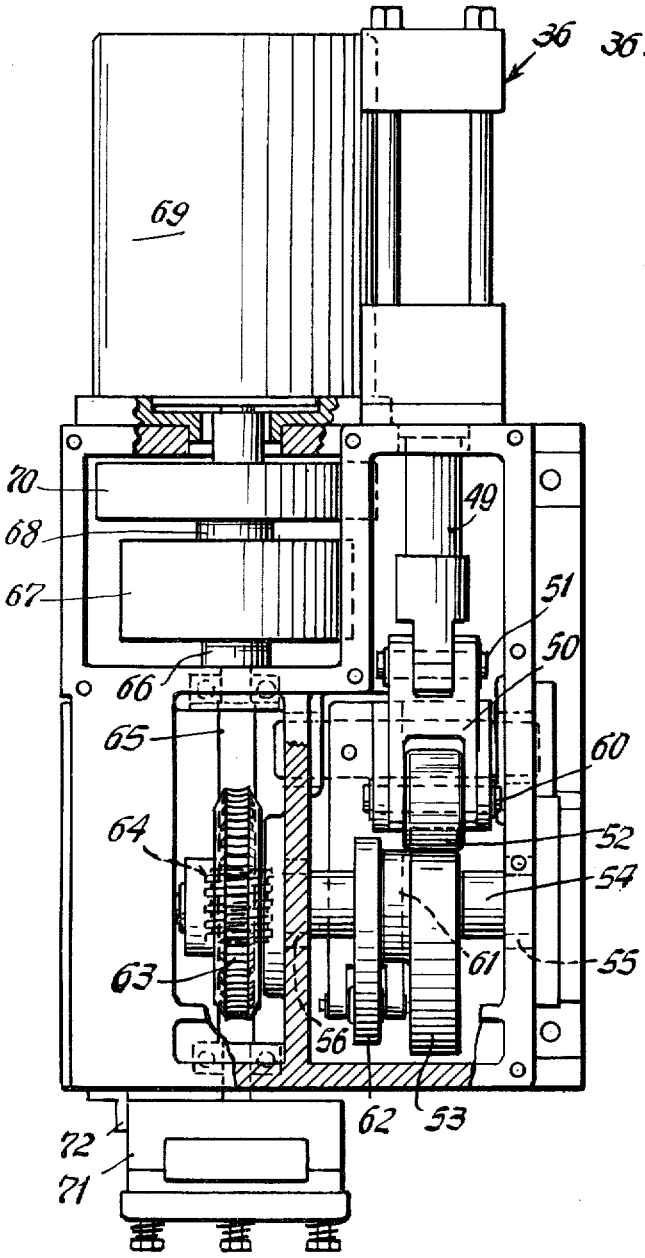
FIG. 3 is an elevation, partly in section, of the components of the pump module which provides the hydraulic operating fluid to the power cylinder.
Figure 4:
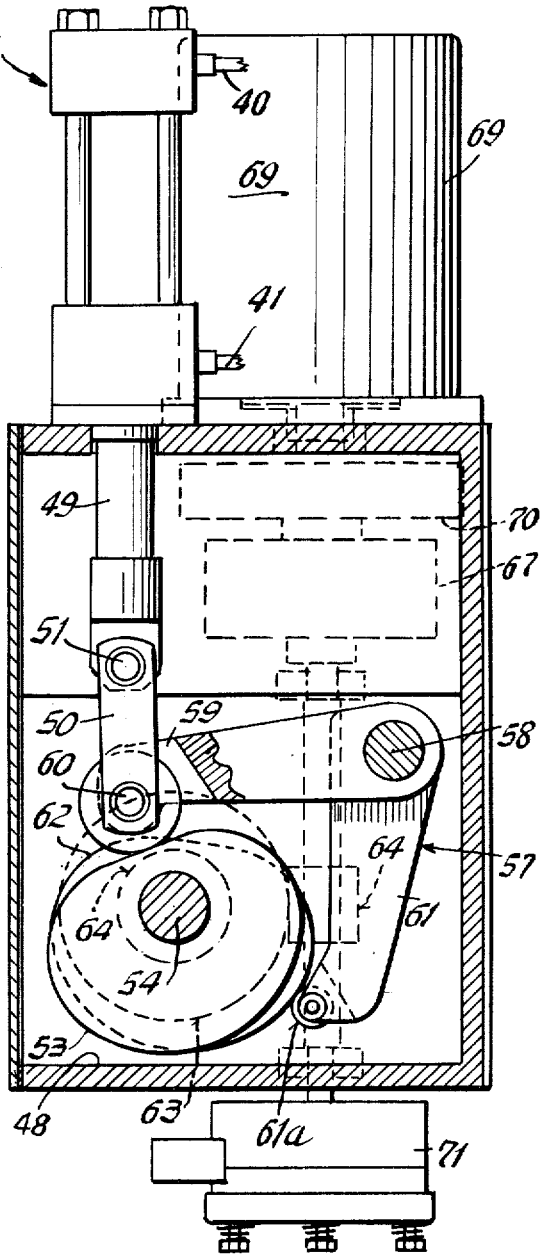
FIG. 4 is a side view thereof partly in section.

Referring to FIGS. 3 and 4, the power module 37 which produces in the hydraulic hoses 40 and 41 the pressure to move the driver includes the pump 36 mounted on top of an open, somewhat rectangular housing 48 to have its piston rod end 49 project thereinto. A double bifurcated link 50 is pivotally mounted on the rod end 49 as at 51 while its other end carries a roller cam follower 52. The cam follower is in engagement with the periphery of a cam 53 mounted for rotation on a cam shaft 54 journaled perpendicular to the rod 49 in the housing as by supports 55 and 56. For assuring engagement of the cam follower with the cam 53, an elbow link 57 is pivoted as at 58 between the supports 55 and 56 and has one leg portion 59 connected to a pin 60 that secures the roller 52 to the link 51.

The roller 52 and cam 53 are only utilized for the advancing, upsetting movement of the driver and to effect the retracting stroke, which requires much less power, another leg 61 of the elbow link 57 carries a cam follower 61a that engages the periphery of a second cam 62 also mounted on the shaft 54. The cams are so designed that no interference will result during the cam rotation with the retracting stroke causing downward movement of the rod end 49 by effecting counterclockwise pivotal movement of the elbow link 57.

The shaft 54 carries a worm gear 63 which is driven by a worm 64 secured on a shaft 65 mounted to be parallel to the rod end 49. The shaft 65 extends upwardly to be connected to the driven side 66 of a clutch 67 having a driving side 68 which is connected to the shaft of an electric motor 69 that is mounted on the top surface of the housing 48. If desired, a fly wheel 70 may be secured onto the motor shaft. The other end of the shaft 65 projects below the housing to be connected to a brake 71. The clutch 67 is of the normally open electrically energizable type in which energization thereof causes a driving connection between the shaft 65 and the motor 69 while electrical deenergization eliminates the connection. The brake 71 is of the spring urged normally closed type but which may be electrically energized to disengage itself from the shaft. A bracket 72 secures the stationary portion of the brake to the housing.

In the above-described construction of the power module, it will be understood that with the motor 69 continually running, energization of the clutch 67 and deenergization of the brake 71 is required to cause the worm 64 to rotate the worm gear 63 and the shaft 54 to produce driver movement. On the other hand, deenergization of both clutch and brake will stop movement of the shaft 54 and brake it against any rotational urgings which the hydraulic pressure could exert. The stopping of the driver is exceedingly fast in view of the quick response of the clutch and brake, the braking of the faster shaft 65 and the few moving parts that are involved.

The present module has one rotation of the cam shaft produce one riveting cycle. However, by using a cam, nonlinear proportionality between cam shaft movement and driver movement is obtained. Thus, the cam periphery preferably has an initial fast raising portion to effect the rapid driver advancing movement, a relatively long intermediate portion for the slow powerful rivet upsetting movement and a relatively short remaining portion for quick driver retraction. The retracting movement is made to assume less than half the cam shaft rotation thereby enabling the system to devote more time during one revolution of the shaft 54 to the advancing and rivet upsetting stroke than to the retracting stroke. Thus a rivet cycling time of perhaps ⅓ of a second is obtainable without excessive speed of the moving parts being required, especially during the upsetting operation.

By altering the cam's periphery, different cycles may be produced.

While the heretofore mentioned specific embodiments of the pump and power cylinder could produce a theoretical 6 inches stroke of the power piston, it has been found desirable to have the maximum useful stroke of the power piston rated and/or set somewhat less, on the order of 4 ½ inches. Even though the pump cylinder provides fluid for an almost 6 inches stroke, the excess fluid over that required for the power piston rivet setting movement is passed by the relief valve 45 to the reservoir 42. On the retraction stroke, it is returned through the one-way valves.

Such excess pump movement has been found to be especially advantageous in a rivet setting machine as it eliminates the need and criticalness in mechanically setting the exact stroke length of the pump and power pistons while simultaneously assuring that the desired maximum force will be exerted by the power piston throughout and particularly at the end of the riveting setting operation. Moreover, by simply changing the value of the relief pressure (which may be easily accomplished by utilizing an adjustable relief valve), the maximum rivet setting force may be varied as required.

Figure 5:
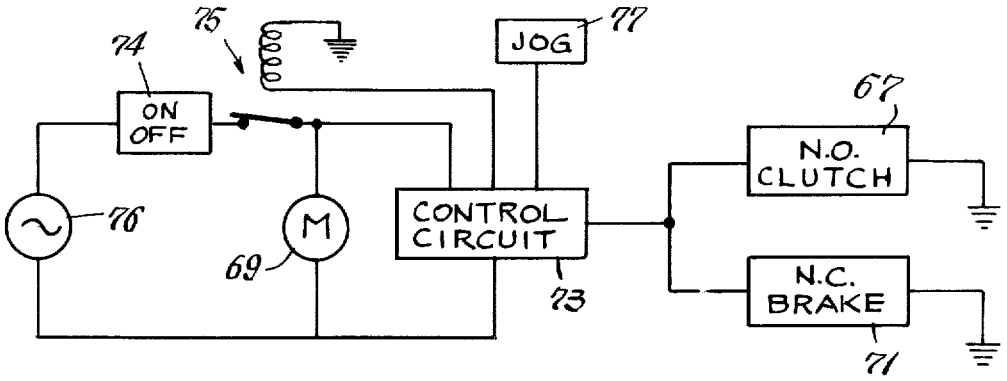
FIG. 5 is a block diagram of the electrical circuit.

Referring to FIG. 5, there is shown a block diagram of the electrical interconnections of the motor 69, normally open clutch 67 and normally closed brake 71. The clutch and brake are connected to receive power from a control circuit 73 which is connected in parallel with the motor 69 and both are connected, through an on-off switch 74 and a normally closed but latchable open relay 75, to a source of electrical energy 76. Relay 75, when deenergized enables power to flow to both the motor and the control circuit. For manually controlling and resetting the system, there is provided a manually operable jog means represented by a "jog" block 77 that is diagrammatically shown as being connected to the control circuit 73.

Figure 6:
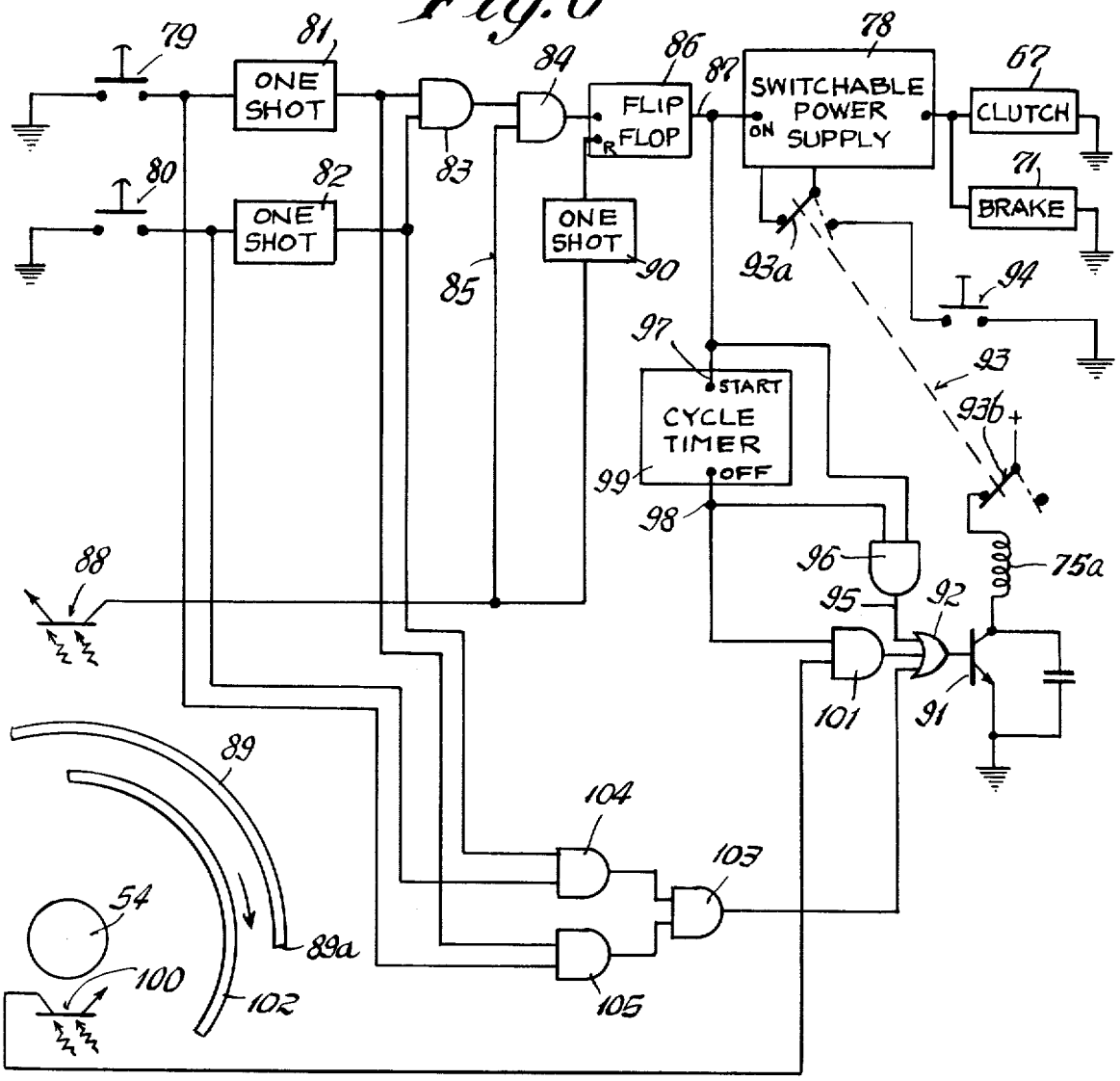
FIG. 6 is an electrical schematic diagram including block and logic components of the control circuit of the present invention.

FIG. 6 discloses the components of the control circuit with the clutch 67 and brake 71 shown connected to a switchable power supply 78 which supplies the energizing power, as for example, 100 volts D.C. thereto. With the relay 75 deenergized to enable power to be supplied to the motor 69 and the control circuit 73, the riveting cycle is initiated by the closure of two normally open switches 79 and 80. The switch 79 is connected to a one shot 81 while the switch 80 is connected to a similar one shot 82 with each one shot upon being actuated, producing a high logic level voltage for a set period of time, as for example, 180 milliseconds which is approximately one-half of the normal riveting cycle time. The output from each one shot is connected as a separate input to an AND gate 83 which has its output serve as an input to another AND gate 84, the latter having another input connected to a lead 85. The output of the AND gate 84 is connected to a set terminal of a flip-flop 86 which, when in the set state, produces on a lead 87 a high logic voltage to an on terminal of the switchable power supply 78.

The power supply 78 is designed to only provide energization to the clutch and brake when its on terminal has a high voltage applied thereto. In the absence of a high logic voltage they are deenergized. When energized, the clutch mechanically couples the motor to the cam shaft 54 while the brake is caused to be released.

The lead 85 is connected to a photoelectric switch 88 which cooperates with an arcuate shutter 89 that is mounted on the cam shaft 54 for movement therewith. The switch 88 and shutter 89 are shown in the position which the parts would occupy when the driver is at its topmost completely retracted rest position. In this position, which is the normal beginning position of the riveting cycle, the shutter 89 blocks light to the photoelectric switch 88 which causes the lead 85 to be at a high logic voltage.

Accordingly, when both inputs to the AND gate 83 are high, by reason of both outputs of the one shots 81 and 82 being high and the lead 85 is high by reason of the shutter being aligned with the photoelectric switch 88, the flip-flop 86 is set to effect movement of the driver.

The flip-flop 86 having been set maintains energization of the clutch and brake to rotate the shaft 54 until the leading edge 89a of the shutter 89 attains a position where it blocks light to the photoelectric switch 88 causing the logic voltage in the lead 85 to shift from low to high. This change actuates a one shot 90 for perhaps 50 milliseconds which is sufficient, as it is connected to the reset terminal of the flip-flop 86, to effect resetting of the flip-flop to shift the voltage on the lead 87 from high to low. The power supply thus becomes deenergized and the machines has completed one riveting cycle. Moreover, the circuit is also in condition to be actuated by the switches 79 and 80 for the next riveting cycle.

The arcuate extent of the leading edge **89*a* from its shown alignment position with respect to the photoelectric switch 88 is determined by the response time necessary to achieve stopping of the cam shaft upon deenergization of the clutch and brake. In addition, while the clutch and brake are shown as being simultaneously energized and deenergized, appropriate delay circuits may be utilized if it is found that they have a different response time to assure that the brake 71 does not provide frictional restraint while the clutch 67** is still engaged.

In the event that the machine should malfunction for any one of a plurality of reasons as hereinafter set forth, the relay 75 is caused to be energized to disconnect the control circuit from the power source 76 and effecting stopping of the driver. To this end, as shown in FIG. 6, the relay coil 75*a* is connected in series with a transistor 91 whose base is connected to the output of an OR gate 92. The relay coil 75*a* is normally not energized and will remain so if the output of the OR gate remains low. However, when the output has a high logic level, the transistor 91 conducts, energizing the relay coil. As the relay is self-latching it retains its energized condition until it becomes manually deenergized.

Manual control over energization of the circuit is achieved by a manually operable double pole double throw jog switch 93 having arms 93*a* and 93*b*. Normal operation has the poles positioned as they are shown in solid lines and they are manually movable to their dotted line position, the latter position causing deenergization of the relay 75*a* to provide power to the control circuit. However, another manual jog switch 94 is provided which when closed causes the power supply to be turned on to supply energization to the clutch and brake for the duration that an operator maintains it closed. Thus, upon malfunctioning, an operator, first shifts the position of switch 93 and then operates switch 94 to produce movement of the driver. After the cam shaft has assumed its normal starting position the switch 93 may be returned to its solid line position enabling normal operation of the system to be resumed.

The output of the OR gate 92 has a high logic voltage whenever any one of its three inputs has a high logic voltage. One input 95 is connected as an output of an AND gate 96 whose two inputs are connected to a start terminal 97 and an off terminal 98 of a cycle timer 99. The start terminal is also connected to the lead 87. The cycle timer is utilized to deenergize the machine in the event the power supply provides energization for a somewhat longer period than that required for a normal cycle and thus may be a set to about 350 milliseconds when the normal cycle is 330 milliseconds. Upon the lead 87 becoming high, the timer begins to time and the off terminal logic voltage is low during this cycle time duration so that the output of the gate 96 is low and hence does not effect conduction of the transistor 91. However, if the lead 87 remains energized after the timer has timed out, the off terminal is then high as is the lead 87 and so the output of the gate 96 by having both inputs high will have a high output, causing energization of the relay 75 and deenergization of the power supply.

In addition to sensing malfunctioning based on the machine duration of energization, the control circuit further provides for sensing if the cam shaft 54 has produced a movement that causes it to overshoot (or undershoot) its normally shown starting position. The position sensing circuit includes a photoelectric switch 100 connected as one input to an AND gate 101 while another input to the AND gate 101 is connected to the timer off terminal 98. The output of the AND gate 101 constitutes one of the inputs to the OR gate 92. The switch 100 is connected to provide a low logic level voltage in the absence of a shutter 102 being aligned therewith and thus in one complete riveting cycle the logic level provided by the photoelectric switch 100 changes from low to high and then to low while the logic level from the cycle time off terminal remains low for the duration of the timing cycle.

In the event that after the timer has timed out, and the cam shaft 54 has produced a movement which causes the shutter 102 to be aligned with the photoelectric switch 100, then both inputs to the gate 101 will be high, producing a high input to the gate 92 and hence energization of the relay coil 75*a*. The shutter 102 may be in alignment with the photoelectric switch if there is either too great a movement of the cam shaft, i.e., more than one revolution or if there is too little, approximately half a revolution, the latter occurring if there is slippage in the clutch. Accordingly, this circuit prevents the machine from initiating a second cycle by sensing the departure of the mechanical position of the cam shaft from an acceptable position.

While the above two circuits prevent further machine operation in the event of machine malfunctioning, a third deenergizing circuit may be used to provide safety for the operator if the switches 79 and 80 are hand operated and spaced apart. The safety circuit requires that the operator maintain the two switches closed for essentially the first half of the riveting cycle which is the duration for which the one shots 81 and 82 are set. If an operator during this time removes a hand from its respective switch then the relay 75 becomes energized by a high logic voltage being applied to the OR gate 92 from a network of AND gates 103, 104 and 105 connected as shown. It will be understood that the palm switches 79 and 80, when closed, provide a low logic level voltage to their respective AND gates and as all inputs to the AND gates 104 and 105 have to be high before the output of gate 103 is high, assurance is thus obtained that the operator must maintain actuation of the switches 79 and 80 for the set duration.

Though two switches have been shown, it is within the scope of the present invention to use other cycle initiating switching mechanism, such as a single switch, automatically operated switches, etc.

Though the herein described embodiment has one power module for providing the power for one riveting machine, it is contemplated that for small riveting machines two or more could be simultaneously powered by the same power module.

It will accordingly be understood that there has been disclosed a riveting machine which uses hydraulic power to actuate the driver tool. The hydraulic power produces motion in a power cylinder that is connected to the driver with the hydraulic power being obtained from a power module that includes a pump cylinder. The pump cylinder is mechanically actuated only when the driver is to be moved and its movement dictates a corresponding related movement by the power cylinder and hence the driver. The mechanical actuation thus enables mechanical devices such as a cam, clutch and brake to control the driver movement rather than hydraulic devices which enhances and produces reliability of operation, ease of selection of operating characteristics, fast response time and efficient energy utilization in a riveting machine.

Variations and modifications may be made within the scope of the claims and portions of the improvements may be used without others.

We claim:

1. A hydraulically actuated riveting machine comprising a frame, means on the frame for supporting a driver for reciprocating movement, anvil means aligned with the driver for cooperation therewith to upset a rivet, a power cylinder having a movable power piston, means interconnecting the power piston to the driver for transmitting movement of the piston into movement of the driver, a pump cylinder having a movable pump piston, means for actuating the pump piston for a riveting cycle, means for transferring the pump piston movement into a relatively corresponding movement of the power piston each cylinder having a housing having a fluid port adjacent each end, a one passageway connected between a port on each cylinder and a second passageway connected between the other two ports to form a closed hydraulic circuit that includes hydraulic fluid contained within the passageways to effect communication between the two cylinders and in which there are pressure relief means for limiting the maximum pressure in the hydraulic circuit with said pressure relief means including a settable pressure relief valve connected between a reservoir and the one passageway and a one way check valve connected between said reservoir and the second passageway with said pressure relief valve being set to permit flow therethrough at the maximum pressure desired in the one passageway whereby movement of the pump piston producing pressure in excess of the maximum pressure has fluid diverted to the reservoir through the pressure relief valve without corresponding movement of the power cylinder piston.

2. The invention as defined in claim 1 in which the second passageway has a second pressure relief valve interconnected between it and the reservoir and in which the one passageway has a check valve connected between it and the reservoir whereby the maximum pressure for each direction of movement of the power piston may be set.

3. A hydraulically actuated riveting machine comprising a frame, means on the frame for supporting a driver for reciprocating movement, anvil means aligned with the driver for cooperation therewith to upset a rivet, a power cylinder having a movable power piston, means for interconnecting the power piston to the driver for transmitting movement of the piston into movement of the driver, pump cylinder having a movable pump piston, means for actuating the pump piston for a riveting cycle, means for transferring the pump piston movement into a relative corresponding movement of the power piston, said means for actuating the pump piston including cam means having a programmed camming portion, follower means mechanically interposed between the camming portion and the pump piston and means for actuating the cam means at an essentially constant speed whereby the speed of movement of the pump piston is essentially dictated by thhe programmed shape of the camming portion, in which the riveting cycle includes an advancing movement towards the anvil means and a retracting movement from the anvil means of the driver for each cycle with the camming portion being shaped to produce a related corresponding movement of the pump piston in one revolution of the cam means, in which the camming portion has a part for effecting advancing movement and a part for effecting retracting movement of the driver and in which the advancing movement part extends over a greater extent of the revolution of the camming means than the retracting movement part.

4. The invention as defined in claim 3 in which the camming portion part for effecting advancing movement includes a first peripheral camming surface and in which the camming portion part for effecting retracting movement includes a second peripheral camming surface.

5. The invention as defined in claim 3 in which the means for rotating the cam for one revolution includes normally energized rotating means for producing rotational movement, energizable clutch means connected between the rotating means and the cam means and means for energizing the clutch means to effect one revolution thereof upon energization of the clutch means.

6. A hydraulically actuated riveting machine comprising a frame, means on the frame for supporting a driver for reciprocating movement, anvil means aligned with the driver for cooperation therewith to upset a rivet, a power cylinder having a movable power piston, means for interconnecting the power piston to the driver for transmitting movement of the piston into movement of the driver, a pump cylinder having a movable pump piston, means for actuating the pump piston, means for transferring the pump piston movement into a relative corresponding movement of the power piston, means upon initiation for normally causing the pump piston actuating means to produce only one complete riveting cycle, in which there are means for sensing the position of the actuating means at the end of each cycle and producing a stop signal if the actuating means has produced an excessive extent of actuation in the cycle and means for receiving the stop signal and preventing the actuating means from causing the next complete riveting cycle.

7. The invention as defined in claim 6 in which the actuating means includes a rotatable shaft and in which the means for producing a stop signal includes switch means for sensing the rotational position of the shaft.

8. The invention as defined in claim 6 in which the actuating means produces one complete riveting cycle in a normal selected time interval, means for sensing and producing a stopping signal if the actuating means is producing actuation for a longer time than the selected time interval and means for receiving the stopping signal and preventing the actuating means from causing the next complete riveting cycle.

9. The invention as defined in claim 6 in which the means for initiating includes a pair of manually actuatable switches and in which there are means for deenergizing the actuating means upon a failure to maintain actuation of both switches for an initial period of the riveting cycle.

10. A hydraulically actuated system comprising a power cylinder adapted to provide a reciprocating movement, a pump cylinder, communicating means connecting the pump cylinder to the power cylinder and including hydraulic fluid whereby movement of the pump cylinder causes by transfer of hydraulic fluid a related corresponding movement of the power cylinder, a rotatably mounted cam shaft, cam means carried by the cam shaft, means including cam follower means connecting the cam means to the pump cylinder to effect a reciprocating movement of the pump cylinder with the pump cylinder's movement being dictated solely by the cam means, a normally energized rotating electric motor, clutch means interposed between the motor and the cam shaft and upon energization providing a driving connection between the motor and the cam shaft, brake means interconnected to the cam shaft for normally providing a braking force and which upon energization removes the braking force, means for essentially simultaneously energizing the clutch means and brake means and in which there is a control circuit connected to control energization of the clutch means and brake means, and for limiting the energization to essentially one revolution of the cam shaft upon initial energization thereof.

11. The invention as defined in claim 10 and in which the limiting means includes switch means for sensing the rotational position of the cam shaft.

* * * * *